US006293832B1

(12) United States Patent
Yamamoto

(10) Patent No.: US 6,293,832 B1
(45) Date of Patent: Sep. 25, 2001

(54) FEMALE METAL TERMINAL

(75) Inventor: Hiroshi Yamamoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/594,812

(22) Filed: Jun. 16, 2000

(30) Foreign Application Priority Data

Jun. 17, 1999 (JP) ..... 11-171610

(51) Int. Cl.[7] ..... H01R 13/11
(52) U.S. Cl. ..... 439/850
(58) Field of Search ..... 439/849–852

(56) References Cited

U.S. PATENT DOCUMENTS

| | | | | |
|---|---|---|---|---|
| 4,699,444 | * | 10/1987 | Isohata | 439/839 |
| 5,611,715 | * | 3/1997 | Samejima | 439/850 |
| 5,639,270 | * | 6/1997 | Barbieri et al. | 439/849 |
| 5,695,352 | * | 12/1997 | Abe | 439/223 |
| 5,735,717 | * | 4/1998 | Nabeshima | 439/851 |
| 6,066,009 | * | 5/2000 | Yamamoto | 439/852 |

FOREIGN PATENT DOCUMENTS

| | | | |
|---|---|---|---|
| 8-250174 | 9/1996 | (JP) | H01R/13/11 |

* cited by examiner

*Primary Examiner*—Paula Bradley
*Assistant Examiner*—Ann McCamey
(74) *Attorney, Agent, or Firm*—Sughrue, Mion, Zinn Macpeak & Seas, PLLC

(57) ABSTRACT

A female metal terminal body (3) of a box-shape has a bottom plate (4) and an insertion port (2) which is formed in one end portion of the metal terminal body (3), and through which a male metal terminal is insertable into the metal terminal body (3). A resilient contact piece portion (5) is formed within the metal terminal body (3), and includes a flexing portion (6), a flat portion (7) extending rearwardly from the flexing portion (6), and a resilient support portion (8) extending from a distal end of the flat portion (7). The resilient contact piece portion (5) is partially divided into a plurality of sections so as to divide the flat portion (7) into a plurality of sub-flat portions (7A, 7B). A plurality of contact portions (12A, 12B) are respectively formed on at least two of the sub-flat portions (7A, 7B) disposed at opposite side portions of the resilient contact piece portion (5). The contact portions (12A, 12B) are extended along upward portions (7Ab, 7Bb) and downward portions (7Aa, 7Ba) of the at least two of the sub-flat portions (7A, 7B) located downwardly from a position against which a distal end of the male metal terminal can abut when the male metal terminal is inserted into the metal terminal body.

9 Claims, 3 Drawing Sheets

FEMALE METAL TERMINAL

BACKGROUND OF THE INVENTION

1. Field of the Invention

The present invention relates to a female metal terminal in which when a male metal terminal is fitted into this female metal terminal, a resilient contact piece portion is resiliently contacted with the male metal terminal to guide the same so as to stabilize the contact thereof with the male metal terminal, thereby preventing the increase of a contact resistance so as to stabilize the electrical connection.

The present application is based on Japanese Patent Application No. Hei. 11-171610, which is incorporated herein by reference.

2. Description of the Related Art

FIGS. 4 and 5 show a conventional female metal terminal disclosed in Unexamined Japanese Patent Publication No. Hei. 8-250174.

In FIGS. 4 and 5, the female metal terminal 1 includes a metal terminal body 3 of a box-shape, having an insertion port 2 for inserting a male metal terminal (not shown) therethrough, and a resilient contact piece portion 5 formed by folding that portion of a bottom plate 4 of the metal terminal body 3, extending from an end of the insertion port 2, back into the interior of the metal terminal body 3. The resilient contact piece portion 5 includes a flexing portion 6, bent into the interior of the metal terminal body 3 at the lower side of the end of the insertion port 2, a slanting portion 7 extending obliquely rearwardly from the flexing portion 6 within the metal terminal body 3, and a resilient support portion 8 which extends from a distal end of the slanting portion 7, and is curved toward the bottom plate 4, and is resiliently held against the bottom plate 4.

When the male metal terminal is inserted into the female metal terminal 1, a distal end of the male metal terminal is brought into resilient contact with the slanting portion 7, so that an inserting resistance is produced. When this inserting operation is completed against this inserting resistance, the male metal terminal is held in resilient contact with contact portions 9, formed on an apex portion of the slanting portion 7, thereby securing a predetermined contact load.

A slit 10 is formed in the resilient contact piece portion 5, and extends from the proximal end thereof, connected to the bottom plate 4, toward the distal end thereof in a direction of insertion of the male metal terminal. Each of the flexing portion 6 and the slanting portion 7 is divided by the slit 10 into two sections in the direction of the width of the resilient contact piece portion 5.

The resilient contact piece portion 5 is thus divided into the two sections by the slit 10. With this construction, when the male metal terminal is inserted in inclined relation to the resilient contact piece portion 5, and is brought into contact with the resilient contact piece portion 5 at one side portion thereof, that section of the resilient contact piece portion 5, with which the male metal terminal first comes into contact, is resiliently deformed in a larger amount to undertake a larger proportion of the inserting force of the male metal terminal. Therefore, the inserting resistance can be reduced as compared with a construction in which the inserting force is received by the whole of a resilient contact piece portion of a single plate-like construction.

The resilient contact piece portion 5 is divided into the two sections by the slit 10 as described above, and in this connection, the two contact portions 9, which contact the male metal terminal when the insertion of this male metal terminal is completed, are formed respectively on the apex portions of the two sections of the slanting portion 7. When the insertion of the male metal terminal is completed, the resilient forces of the two sections of the resilient contact piece portion 5 act on the male metal terminal through the respective contact portions 9, and therefore the large contact load can be secured.

In this conventional female metal terminal, when the male metal terminal is inserted into the female metal terminal 1 through the insertion port 2 as shown in FIG. 6, the distal end of the male metal terminal is first brought into contact with the slanting portion 7 of the resilient contact piece portion 5 of the female terminal 1. When the male metal terminal, thus contacted with the slanting portion 7 of the resilient contact piece portion 5, is further inserted, the distal end of the male metal terminal, is guide by the slanting portion 7, and slides over this slanting portion 7 to advance within the female metal terminal 1 while pressing the resilient contact piece portion 5 toward the bottom plate 4. Then, this distal end abuts against the contact portions 9 formed on the apex portion of the slanting portion 7. When the male metal terminal is further inserted, with its distal end thus abutted against the contact portions 9, the distal end of the male metal terminal shaves surface portions of the contact portions 9 or almost the whole of the contact portions 9.

When even the surface portions (part) of the contact portions 9 are thus shaved by the distal end of the male metal terminal, there is encountered a problem that the contact of the contact surfaces of the contact portions 9 becomes unstable, and this unstable contact invites the increase of the contact resistance, so that the electrical connection becomes unstable.

SUMMARY OF THE INVENTION

It is an object of the present invention to provide a female metal terminal in which contact portions, formed on an apex portion of a slanting portion of a resilient contact piece portion, will not be shaved by a distal end of a male metal terminal, and the contact of the male metal terminal with the contact portions is stabilized so as to prevent the increase of a resistance of contact between the contact portions and the male metal terminal, thereby stabilizing the electrical connection.

To achieve the above object, according to the first aspect of the present invention, there is provided a female metal terminal which comprises a metal terminal body having a bottom plate and an insertion port which is formed in one end portion of the metal terminal body, and through which a male metal terminal is insertable into the metal terminal body, a resilient contact piece portion formed within the metal terminal body, the resilient contact piece portion including a flexing portion formed by folding back an extending portion of the bottom plate of the metal terminal body from the insertion port into an interior of the metal terminal body, a flat portion extending rearwardly from the flexing portion within the metal terminal body, and a resilient support portion extending from a distal end of the flat portion, curved toward the bottom plate, and held against the bottom plate, wherein the resilient contact piece portion is partially divided into a plurality of sections so as to divide the flat portion into a plurality of sub-flat portions, and a plurality of contact portions respectively formed on at least two of the sub-flat portions disposed at opposite side portions of the resilient contact piece portion, the contact portions being extended along upward portions and downward portions of the at least two of the sub-flat portions located downwardly from a position against which a distal end of the male metal terminal can abut when the male metal terminal is inserted into the metal terminal body.

Accordingly, the distal end of the male metal terminal will not shave the contact portions, and the contact of the contact portions with the male metal terminal is stabilized, and the resistance of contact of the contact portions with the male metal terminal is prevented from increasing, thereby stabilizing the electrical connection.

To achieve the above object, according to the second aspect of the present invention, it is preferable that the resilient contact piece portion is partially divided into at least three sections by slits, and the resilient support portion has, at a distal end portion thereof, a connecting portion which interconnects between at least two of the sections formed by dividing the resilient contact piece portion. With this construction of the female metal terminal, when the distal end of the male metal terminal is inserted, the plurality of divided sections of resilient contact piece portion separated from each other, are prevented from being resiliently deformed independently of each other. Therefore, the resistance of contact of the contact portions with the male metal terminal is prevented from increasing, thereby stabilizing the electrical connection.

To achieve the above object, according to the third aspect of the present invention, it is preferable that the slits are formed in the flexing portion, the flat portion and at least a part of the resilient support portion of the resilient contact piece portion. In this construction of the female metal terminal, the slits are formed not only in the flat portion, with which the male metal terminal can come into direct contact, but also in the flexing portion, and therefore the sub-flat portions can be resiliently deformed more independently of each other during the insertion of the male metal terminal, so that the inserting resistance can be reduced.

To achieve the above object, according to the fourth aspect of the present invention, it is preferable that at least two of the sub-flat portions, on which the contact portions are formed, include the upward portions each having an inclination angle smaller than an inclination angle of each of the downward portions relative to the bottom plate of the metal terminal body. With this construction, the amount of shaving of the contact portions by the distal end of the male metal terminal is reduced.

Further, according to the fifth aspect of the present invention, the distal end portion of the resilient support portion may be divided by at least one slit.

DETAILED DESCRIPTION OF THE PREFERRED EMBODIMENT

A preferred embodiment of the present invention will now be described with reference to FIGS. 1 to 3.

Figure 1:
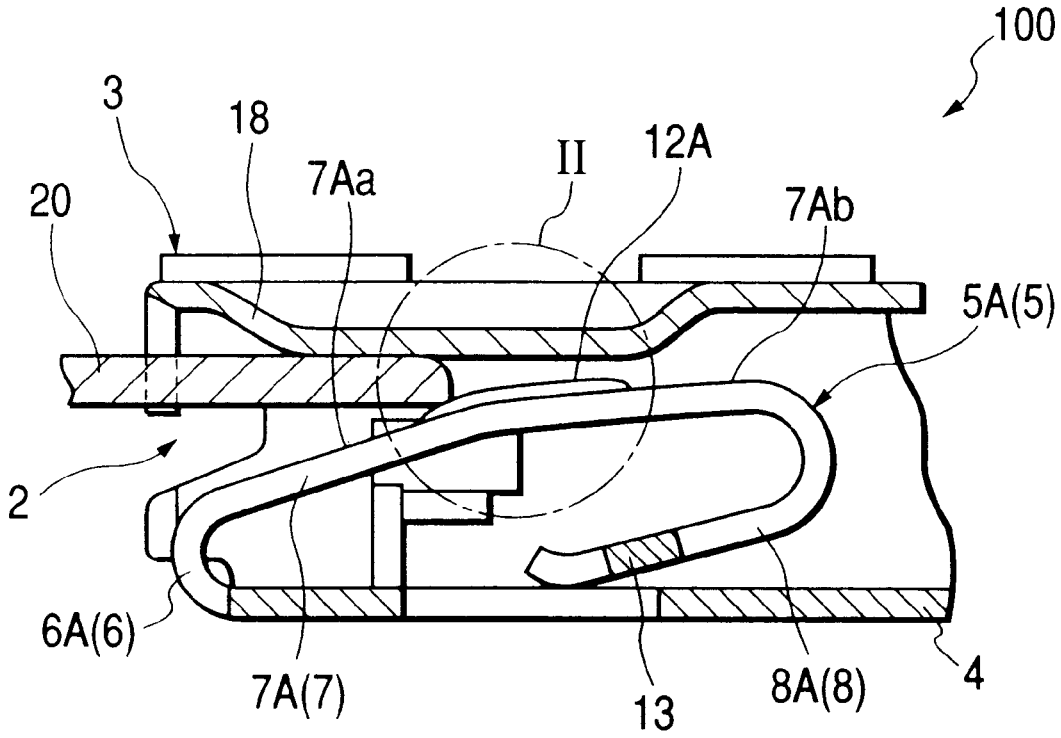
FIG. 1 is a cross-sectional view of a preferred embodiment of a female metal terminal of the present invention.
Figure 2:
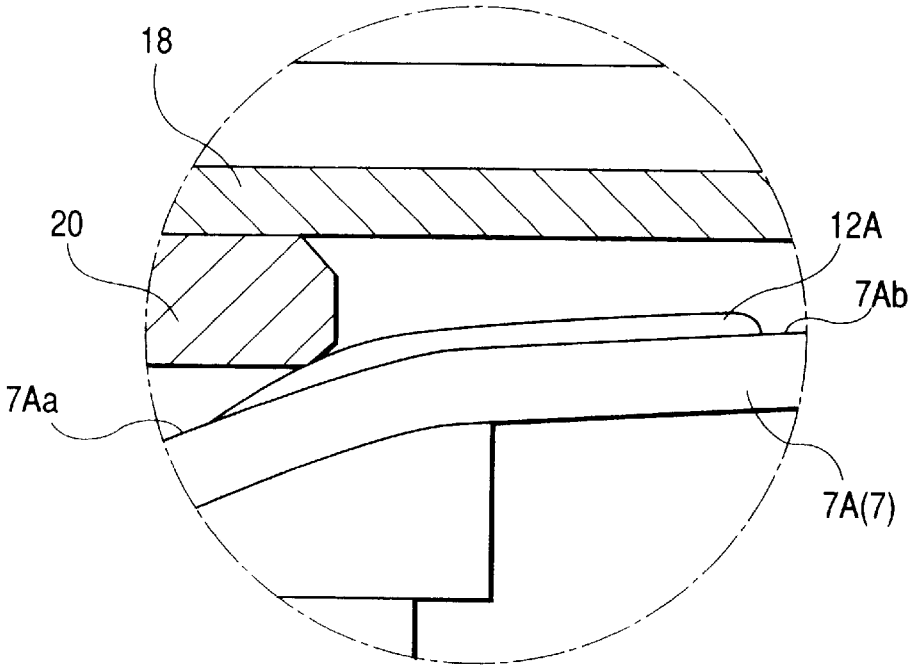
FIG. 2 is an enlarged view of a portion II of FIG. 1.
Figure 3:
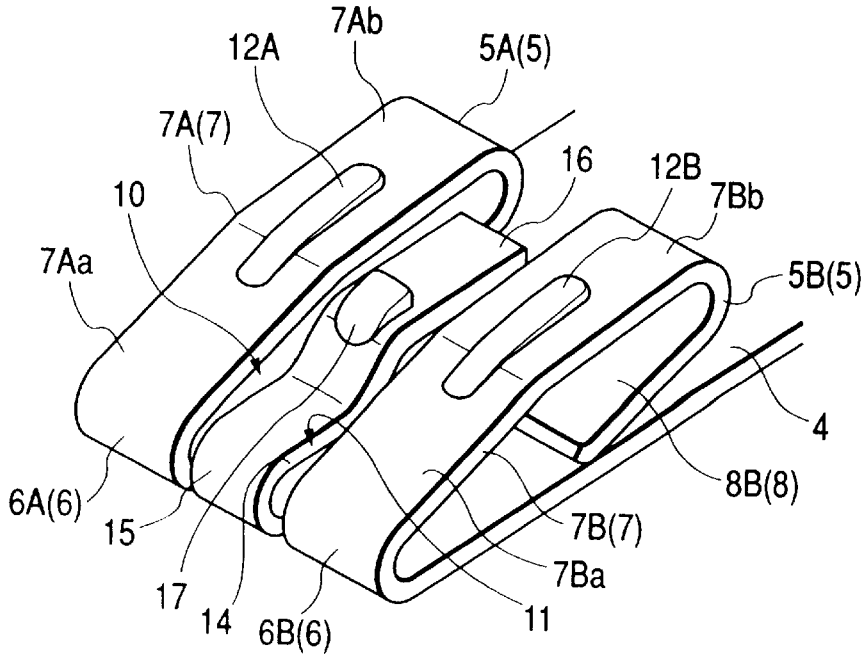
FIG. 3 is a perspective view of a resilient contact piece portion shown in FIG. 1.
Figure 4:
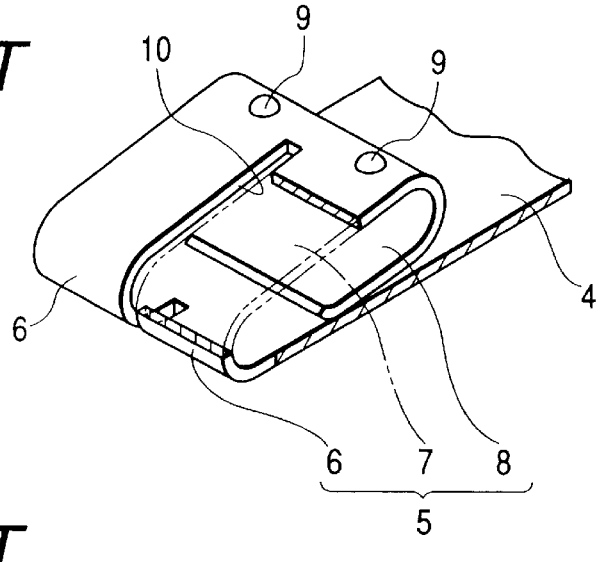
FIG. 4 PRIOR ART
FIG. 4 is a perspective view of a conventional resilient contact portion.
Figure 5:
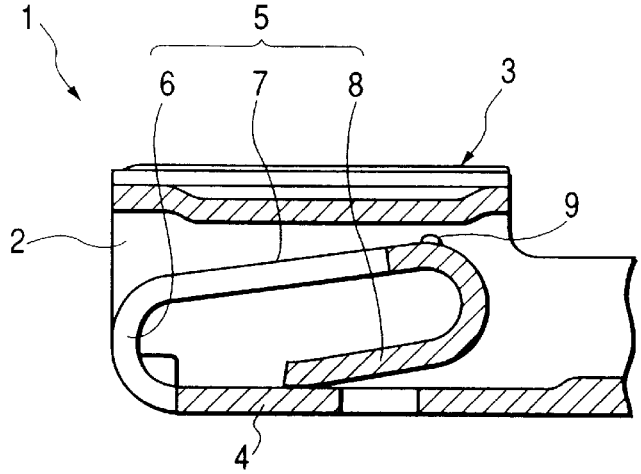
FIG. 5 PRIOR ART
FIG. 5 is a cross-sectional view of a conventional female metal terminal.
Figure 6:
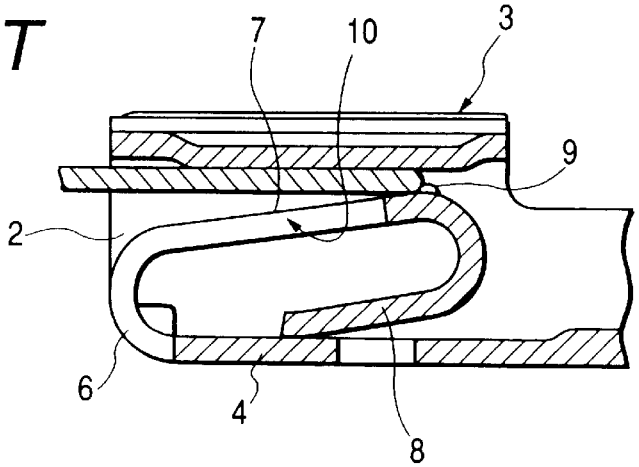
FIG. 6 PRIOR ART
FIG. 6 is a view of the female metal terminal of FIG. 5, showing a condition in which a terminal portion of a male metal terminal is inserted into this female metal terminal.

In FIGS. 1 to 3, a female metal terminal 100 is formed or shaped by bending an electrically-conductive metal sheet of a predetermined shape, and as a whole, this female metal terminal includes a wire connection portion (not shown), a metal terminal body 3, and a resilient contact piece portion 5.

The metal terminal body 3 is disposed forwardly of the wire connection portion (not shown), and has a generally box-shape with a square cross-section. An insertion port 2 is formed in one end of the metal terminal body 3 over an entire area thereof, and a terminal portion 20 of a male metal terminal (not shown) can be inserted through this insertion port 2.

The resilient contact piece portion 5 has a construction as shown in FIG. 3, and is formed by bending or folding that portion (strip-like portion of a predetermined width) of a bottom plate 4 of the metal terminal body 3, extending from an end of the insertion port 2 in a direction of the length, into the interior of the metal terminal body 3. More specifically, the resilient contact piece portion 5 includes a flexing portion 6, bent upwardly into a U-shape at the end of the insertion port 2, a flat portion 7 extending obliquely upwardly rearwardly from the flexing portion 6 within the hollow metal terminal body 3, and a resilient support portion 8 which extends from a distal end of the flat portion 7, and is curved downwardly into a U-shape, and further extends generally parallel to the flat portion 7. A distal end of the resilient support portion 8 is held against the bottom plate 4.

Slits 10 and 11 are formed in the resilient contact piece portion 5, and more specifically are formed in the flexing portion 6, the flat portion 7 and the resilient support portion 8, and extend in a direction of extending of the flat portion 7 (that is, in a direction of insertion of the male metal terminal). The resilient contact piece portion 5 is divided by the two slits 10 and 11 into two resilient contact piece sections 5A and 5B, with a retaining piece portion 14 interposed therebetween.

Therefore, the resilient contact piece section 5A includes a flexing portion 6A, bent upwardly into a U-shape at the end of the insertion port 2, a flat portion 7A extending obliquely upwardly rearwardly from the flexing portion 6A within the hollow metal terminal body 3, and a resilient support portion 8A which extends from a distal end of the flat portion 7A, and is curved downwardly into a U-shape, and further extends generally parallel to the flat portion 7A. A contact portion 12A is formed on the flat portion 7A of the resilient contact piece section 5A, and extends from an apex portion of the flat portion 7A toward the flexing portion 6A and more specifically to a position disposed downwardly of (that is, offset toward the flexing portion 6A from) that portion of the flat portion 7A against which the distal end of the terminal portion 20 of the male metal terminal can abut when this terminal portion 20 is inserted. The flat portion 7A of the resilient contact piece section 5A is bent at a position between that portion of the flat portion 7A, against which the distal end of the terminal portion 20 of the male metal terminal can abut when this terminal portion 20 is inserted, and the apex portion of the flat portion 7A, to provide a gentle flat portion 7Ab which has a smaller inclination angle relative to the bottom plate 4, and therefore is more parallel to the bottom plate 4. Thus, the flat portion 7A is bent into a generally inverted V-shape to provide an abrupt flat portion 7Aa and the gentle flat portion 7Ab.

Thus, the flat portion 7A of the resilient contact piece section 5A is bent at the position between that portion of the flat portion 7A, against which the distal end of the terminal portion 20 of the male metal terminal can abut when this terminal portion 20 is inserted, and the apex portion of the flat portion 7A, to provide the abrupt flat portion 7Aa and the gentle flat portion 7Ab which has the smaller inclination angle relative to the bottom plate 4, and therefore is more parallel to the bottom plate 4. With this construction in which that portion (gentle flat portion 7Ab) of the flat portion 7A, disposed upwardly of that portion of the flat portion 7A against which the distal end of the terminal portion 20 of the male metal terminal can abut, has a reduced inclination angle relative to the bottom plate 4, the amount of shaving of the contact portion 12A (formed on the flat portion 7A of the resilient contact piece section 5A) by the distal end of the terminal portion 20 of the male metal terminal can be reduced in the vicinity of the apex portion of the flat portion 7A.

In FIG. 1, although the gentle flat portion 7Ab has the predetermined angle relative to the bottom plate 4, this angle relative to the bottom plate 4 may be 0 degree, that is, the gentle flat portion 7Ab may be parallel to the bottom plate 4. In the case where the flat portion 7A is bent at such an angle that the gentle flat portion 7Ab becomes parallel to the bottom plate 4, the distal end of the terminal portion 20 of the male metal terminal, when inserted, abuts against the abrupt flat portion 7Aa of the flat portion 7A of the resilient contact piece section 5A, and the terminal portion 20 of the male metal terminal is further inserted in contact with the contact portion 12A, and there is achieved an advantage that the inserting load is reduced when the distal end of the terminal portion 20 passes the abrupt flat portion 7Aa of the flat portion 7A.

The resilient contact piece section 5B includes a flexing portion 6B, bent upwardly into a U-shape at the end of the insertion port 2, a flat portion 7B extending obliquely upwardly rearwardly from the flexing portion 6B within the hollow metal terminal body 3, and a resilient support portion 8B which extends from a distal end of the flat portion 7B, and is curved downwardly into a U-shape, and further extends generally parallel to the flat portion 7B. A contact portion 12B is formed on the flat portion 7B of the resilient contact piece section 5B, and extends from an apex portion of the flat portion 7B toward the flexing portion 6B and more specifically to a position disposed downwardly of (that is, offset toward the flexing portion 6B from) that portion of the flat portion 7B against which the distal end of the terminal portion 20 of the male metal terminal can abut when this terminal portion 20 is inserted. The flat portion 7B of the resilient contact piece section 5B is bent at a position between that portion of the flat portion 7B, against which the distal end of the terminal portion 20 of the male metal terminal can abut when this terminal portion 20 is inserted, and the apex portion of the flat portion 7B, to provide a gentle flat portion 7Bb which has a smaller inclination angle relative to the bottom plate 4, and therefore is more parallel to the bottom plate 4. Thus, the flat portion 7B is bent into a generally inverted V-shape to provide an abrupt flat portion 7Ba and the gentle flat portion 7Bb.

Thus, the flat portion 7B of the resilient contact piece section 5B is bent at the position between that portion of the flat portion 7B, against which the distal end of the terminal portion 20 of the male metal terminal can abut when this terminal portion 20 is inserted, and the apex portion of the flat portion 7B, to provide the abrupt flat portion 7Ba and the gentle flat portion 7Bb which has the smaller inclination angle relative to the bottom plate 4, and therefore is more parallel to the bottom plate 4. With this construction in which that portion (gentle flat portion 7Bb) of the flat portion 7B, disposed upwardly of that portion of the flat portion 7B against which the distal end of the terminal portion 20 of the male metal terminal can abut, has a reduced inclination angle relative to the bottom plate 4, the amount of shaving of the contact portion 12B (formed on the flat portion 7B of the resilient contact piece section 5B) by the distal end of the terminal portion 20 of the male metal terminal can be reduced in the vicinity of the apex portion of the flat portion 7B.

In FIG. 1, although the gentle flat portion 7Bb has the predetermined angle relative to the bottom plate 4, this angle relative to the bottom plate 4 may be 0 degree, that is, the gentle plate portion 7Bb may be parallel to the bottom plate 4. In the case where the flat portion 7B is bent at such an angle that the gentle flat portion 7Bb becomes parallel to the bottom plate 4, the distal end of the terminal portion 20 of the male metal terminal, when inserted, abuts against the abrupt flat portion 7Ba of the flat portion 7B of the resilient contact piece section 5B, and the terminal portion 20 of the male metal terminal is further inserted in contact with the contact portion 12B, and there is achieved an advantage that the inserting load is reduced when the distal end of the terminal portion 20 passes the abrupt flat portion 7Ba of the flat portion 7B.

The resilient support portion 8A of the resilient contact piece section 5A and the resilient support portion 8B of the resilient contact piece section 5B are integrally interconnected at their distal end portions by a connecting portion 13. The distal end portion of the resilient support portion 8A and the distal end portion of the resilient support portion 8B are thus interconnected by the connecting portion 13, and with this construction when the distal end of the terminal portion 20 of the male metal terminal is inserted, the resilient contact piece sections 5A and 5B, separated from each other, are prevented from being resiliently deformed independently of each other. Therefore, the resistance of contact of the contact portions 12A and 12B with the terminal portion 20 of the male metal terminal is prevented from increasing, thereby stabilizing the electrical connection.

When the male metal terminal is inserted, the retaining piece portion 14 engages the male metal terminal, and serves to prevent the inserted male metal terminal from withdrawal. Like the resilient contact piece sections 5A and 5B, the retaining piece portion 14 includes a flexing portion 15, bent upwardly into a U-shape at the end of the insertion port 2, and a flat portion 16 extending obliquely upwardly rearwardly from the flexing portion 15 within the hollow metal terminal body 3. A retaining portion 17 for engagement with an engagement portion of the male metal terminal (not shown) is formed on an upper surface of the retaining piece portion 14.

When the terminal portion 20 of the male metal terminal is inserted into the metal terminal body 3 of the female metal terminal of the above construction through the insertion port 2, the terminal portion 20 of the male metal terminal is pressed against the upper surfaces of the flat portions 7A and 7B of the resilient contact piece sections 5A and 5B and the upper surface of the flat portion 16 of the retaining piece portion 14. As a result, the flexing portions 6A and 6B of the resilient contact piece sections 5A and 5B and the flexing portion 15 of the retaining piece portion 14 are flexed (resiliently deformed), and also the resilient support portions 8A and 8B are also resiliently deformed, and therefore because of the resilient forces of these portions, the inserting resistance develops between the terminal portion 20 of the male metal terminal and the two resilient contact piece sections 5A and 5B.

At this time, the flat portions 7A and 7B of the resilient contact piece sections 5A and 5B press the terminal portion 20 of the male metal terminal hard against a top plate 18 of the metal terminal body 3 under the influence of the resilient support portions 8A and 8B. Namely, the flat portions 7A and 7B of the resilient contact piece sections 5A and 5B, pressing the terminal portion 20 of the male metal terminal against the top plate 18 of the metal terminal body 3, the flexing portions 6A and 6B, continuous respectively with these flat portions 7A and 7B, and the resilient support portions 8A and 8B undertake a large proportion of the inserting force, and the resilient forces of the flexing portions 6A and 6B and the resilient support portions 8A and 8B mainly serve as the inserting resistance.

When the terminal portion 20 of the male metal terminal is inserted into the metal terminal body 3 through the insertion port 2 as shown in FIG. 1, the distal end of the terminal portion 20 of the male metal terminal first abuts against those portions of the contact portions 12A and 12B disposed respectively on the abrupt flat portions 7Aa and 7Ba of the resilient contact piece sections 5A and 5B, as shown in FIG. 2. In this abutted position, the abrupt flat portions 7Aa and 7Ba of the resilient contact piece sections 5A and 5B offer the inserting resistance relative to the distal end of the terminal portion 20 of the male metal terminal, and therefore the distal end of the terminal portion 20 of the male metal terminal shaves the contact portions 12A and 12B. When the terminal portion 20 of the male metal terminal is further inserted into the metal terminal body 3, the distal end of the terminal portion 20 advances while shaving the contact portions 12A and 12B abutted against this distal end, and when the distal end of the terminal portion 20 reaches the gentle flat portions 7Ab and 7Bb, the pressing force, applied from the flat portions 7A and 7B of the resilient contact piece sections 5A and 5B to the distal end of the terminal portion 20 of the metal male terminal, is reduced, so that the inserting resistance is reduced. As a result, the distal end of the terminal portion 20 of the male metal terminal ceases to shave the contact portions 12A and 12B, and this distal end continues to be inserted while guided by those portions of the contact portions 12A and 12B disposed respectively on the gentle flat portions 7Ab and 7Bb.

In the illustrated embodiment, although the resilient contact piece portion 5 is divided into the two resilient contact piece sections 5A and 5B by the two slits 10 and 11, the resilient contact piece portion 5 can be divided into three or four resilient contact piece sections by providing three or four slits. The number of division sections of the resilient contact piece portion 5 is determined by the pressing force of the resilient contact piece portion to press the terminal portion of the male metal terminal against the top plate of the metal terminal body.

The female metal terminal of the present invention, having the above construction, achieves the following advantageous effects.

In the first aspect of the present invention, the distal end of the male metal terminal will not shave the contact portions, formed on the apex portion of the flat portion of the resilient contact piece portion, and the contact of the contact portions with the male metal terminal is stabilized, and the resistance of contact of the contact portions with the male metal terminal is prevented from increasing, thereby stabilizing the electrical connection.

In the second aspect of the present invention, when the distal end of the male metal terminal is inserted, the resilient contact piece sections, separated from each other, are prevented from being resiliently deformed independently of each other. Therefore, the resistance of contact of the contact portions with the male metal terminal is prevented from increasing, thereby stabilizing the electrical connection.

In the third aspect of the present invention, the slits are formed not only in the flat portion, with which the male metal terminal can come into direct contact, but also in the flexing portion, and therefore the flat portions can be resiliently deformed more independently of each other during the insertion of the male metal terminal, so that the inserting resistance can be reduced.

In the fourth aspect of the present invention, the amount of shaving of the contact portions (on the flat portion of the resilient contact piece portion) by the distal end of the male metal terminal is reduced.

What is claimed is:

1. A female metal terminal, comprising:

a metal terminal body having a bottom plate and an insertion port which is formed in one end portion of the metal terminal body, and through which a male metal terminal is insertable into the metal terminal body;

a resilient contact piece portion formed within the metal terminals body, the resilient contact piece portion including:

a flexing portion formed by folding back an extending portion of the bottom plate of the metal terminal body from the insertion port into an interior of the metal terminal body, a flat portion extending rearwardly from the flexing portion within the metal terminal body, and a resilient support portion extending from a distal end of the flat portion, curved toward the bottom plate, and held against the bottom plate, wherein the resilient contact piece portion is partially divided into a plurality of sections so that the flat portion is divided into a plurality of sub-flat portions; and a plurality of contact portions respectively formed on at least two of the sub-flat portions disposed at opposite side portions of the resilient contact piece portion, the contact portions being extended along upward portions and downward portions of the at least two of the sub-flat portions located downwardly from a position against which a distal end of the male metal terminal can abut when the male metal terminal is inserted into the metal terminal body, wherein the upward and downward portions are inclined, from a terminal insertion direction of the male metal terminal, greater than 0 degrees relative to the bottom plate of the metal terminal body, and the upward and downward portions are inclined at different degrees.

2. The female metal terminal of claim 1, wherein at least two of the sub-flat portions, on which the contact portions are formed, include the upward portions each having an inclination angle smaller than an inclination angle of each of the downward portions relative to the bottom plate of the metal terminal body.

3. The female metal terminal of claim 1, wherein the resilient contact piece portion is partially divided along an insertion direction of the male metal terminal.

4. The female metal terminal of claim 1, wherein the upward and downward portions are inclined, from the terminal insertion direction of the male metal terminal, greater than 0 degrees relative to the bottom plate of the metal terminal body in a non-contact state with the male metal terminal.

5. The female metal terminal of claim 1, wherein the resilient contact piece portion is partially divided into at least three sections by slits, and the resilient support portion has, at a distal end portion thereof, a connecting portion which interconnects between at least two of the sections formed by dividing the resilient contact piece portion.

6. The female metal terminal of claim 5, wherein at least two of the sub-flat portions, on which the contact portions are formed, include the upward portions each having an inclination angle smaller than an inclination angle of each of the downward portions relative to the bottom plate of the metal terminal body.

7. The female metal terminal of claim 5, wherein the slits are formed in the flexing portion, the flat portion and at least a part of the resilient support portion of the resilient contact piece portion.

8. The female metal terminal of claim 7, wherein at least two of the sub-flat portions, on which the contact portions are formed, include the upward portions each having an inclination angle smaller than an inclination angle of each of the downward portions relative to the bottom plate of the metal terminal body.

9. The female metal terminal of claim 7, wherein the distal end portion of the resilient support portion is divided by at least one slit.

* * * * *